US007655876B2

(12) United States Patent
Srinivasan et al.

(10) Patent No.: US 7,655,876 B2
(45) Date of Patent: Feb. 2, 2010

(54) METHOD AND APPARATUS FOR SENSING CONTACT POSITION

(75) Inventors: Jeganathan Srinivasan, Tamilnadu (IN); Nilanjan Ray Chaudhuri, West Bengal (IN); Raghunath Prabhu, Karnataka (IN); Sirosh Sivasankaran, Karnataka (IN); Kalyana Sundaram, Bangalore (IN)

(73) Assignee: General Electric Company, Schenectady, NY (US)

( * ) Notice: Subject to any disclaimer, the term of this patent is extended or adjusted under 35 U.S.C. 154(b) by 78 days.

(21) Appl. No.: 11/867,769

(22) Filed: Oct. 5, 2007

(65) Prior Publication Data

US 2009/0090604 A1 Apr. 9, 2009

(51) Int. Cl.
*H01H 9/00* (2006.01)

(52) U.S. Cl. ..... 200/308; 200/337

(58) Field of Classification Search ..... 200/308, 200/331, 401, 330–337

See application file for complete search history.

(56) References Cited

U.S. PATENT DOCUMENTS

| | | | | |
|---|---|---|---|---|
| 3,916,133 | A * | 10/1975 | Bollinger et al. | 200/308 |
| 5,477,016 | A * | 12/1995 | Baginski et al. | 200/43.11 |
| 5,907,267 | A | 5/1999 | Reid et al. | |
| 5,954,413 | A * | 9/1999 | Brown | 312/328 |
| 6,313,418 | B1 * | 11/2001 | Reneau | 200/61.49 |
| 6,380,501 | B1 * | 4/2002 | Figueroa et al. | 200/308 |
| 6,433,290 | B1 * | 8/2002 | Ulerich et al. | 200/308 |

* cited by examiner

*Primary Examiner*—Renee S Luebke
*Assistant Examiner*—Lisa Klaus
(74) *Attorney, Agent, or Firm*—GE Global Patent Operation

(57) ABSTRACT

A device for sensing the position of a contact carrier of a contact includes a housing, a sensor supported by the housing and a latch that is movable by the contact carrier. The latch has a latch member located in proximity to the sensor and that is generally non-reflective. The sensor is configured to sense a presence or an absence of the latch member at one particular location depending upon the position of the contact carrier. A method of sensing position of a contact carrier of a contact module is also presented.

4 Claims, 5 Drawing Sheets

METHOD AND APPARATUS FOR SENSING CONTACT POSITION

BACKGROUND OF THE INVENTION

1. Field of the Invention

The subject matter described herein relates generally to devices and methods for position sensing and, more particularly, to devices and methods for sensing the position of contacts.

2. Related Art

Various contact position sensors are known. For example, U.S. Pat. No. 5,907,267 describes photoelectric reflective object sensors mounted in an exteriorly mounted auxiliary switch case to detect, through a housing, a member on a movable contact assembly of the contactor to produce logic level output signals indicative of the operational state of the contactor electromagnet. One or a pair of photoelectric sensors is used in a side mounted auxiliary switch to detect the contactor movable contact assembly in the energized or de-energized position, or en route between the two positions.

The use of photoelectric reflective object sensors has been found to significantly increase cost and leads to high inaccuracy of the position sensing. Accordingly, to date, no suitable device or method of sensing a position of a contact is available.

BRIEF DESCRIPTION OF THE INVENTION

In accordance with an embodiment of the present invention, a device for sensing the position of a contact carrier of a contact, comprises a housing, a sensor supported by the housing and a latch that is movable by the contact carrier. The latch comprises a latch member located in proximity to the sensor and that is generally non-reflective. The sensor is configured to sense a presence or an absence of the latch member at one particular location depending upon the position of the contact carrier.

In another aspect of the invention, a method of sensing position of a contact carrier of a contact module comprises providing an opaque and generally non-reflective latch; biasing the latch into engagement with the contact carrier; and sensing the presence or absence of the latch at a particular location using a transmissive optical sensor.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a device and a method for sensing the position of a contact comprising a contact carrier. In accordance with this embodiment, a latch is supported by a housing and in engagement with the contact carrier. The latch includes a latch member and a sensor is configured to sense a presence or an absence of the latch member at one particular location depending upon the position of the contact carrier. Use of the latch allows for reduced cost and higher accuracy sensor to be employed.

Figure 1:
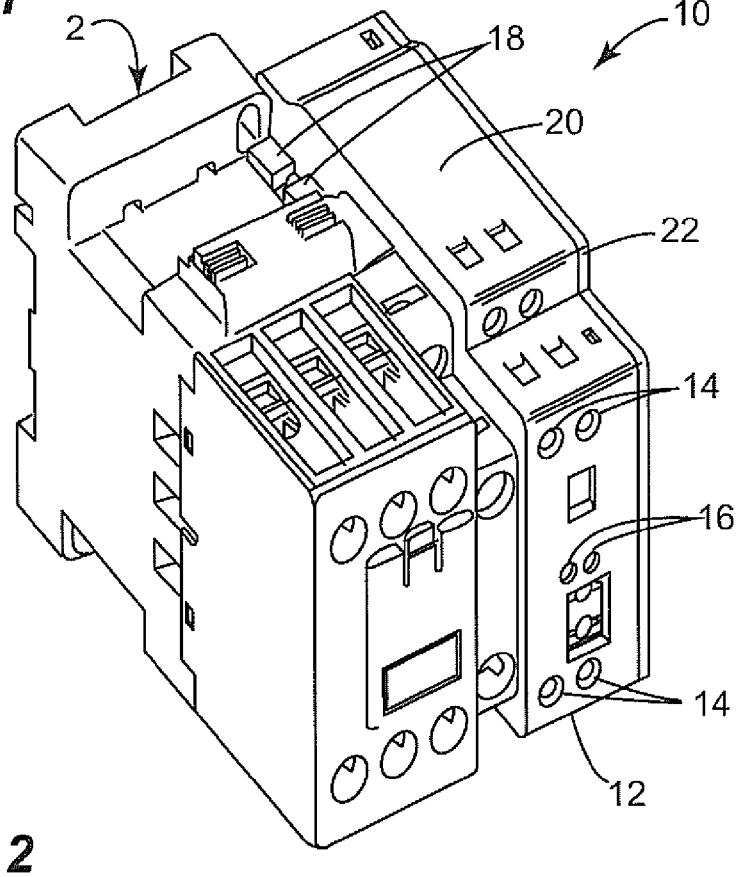
FIG. 1 is a perspective view of a contact position sensor module in accordance with one embodiment of the present invention mounted to a contactor module.

Referring now to FIG. 1, a contact sensor module, in accordance with one embodiment of the present invention is illustrated generally at 10 and, is shown mounted to a contact module 2. The contact module 2 may comprise a circuit breaker (not shown) that, in turn, comprises a contact carrier 4 (diagrammatically shown in FIG. 6) that is movable in direction of arrow 6.

Figure 2:
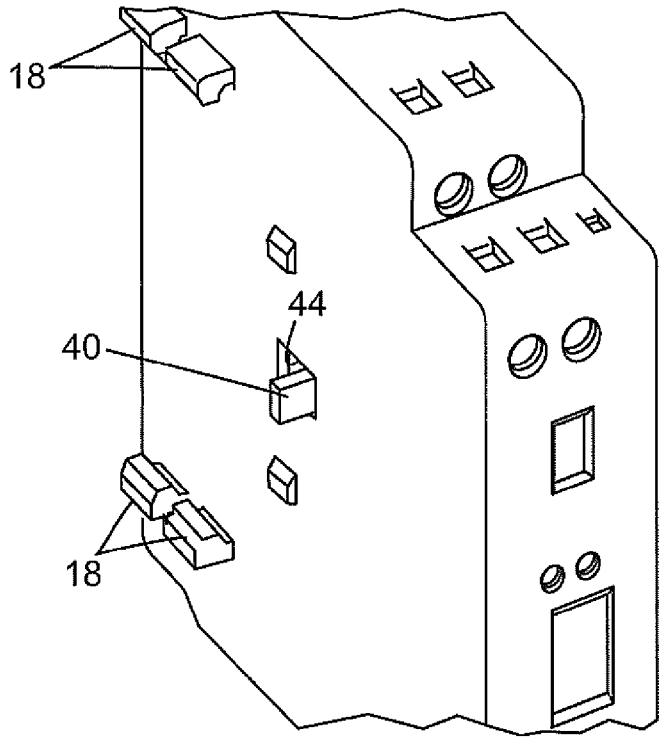
FIG. 2 is a perspective view of a housing and a latch protrusion of the contact position sensor module of FIG. 1.

The contact sensor module 10 comprises a housing 12 that may comprise any suitably durable and moldable material such as a polymeric substance. The housing may include ports 14 to route contactor power through communication module and port 16 for various indicators such as power "on" and communication error condition indication. Referring also to FIG. 2, the housing 12 also includes mounting tabs 18 for clamping to the contact module 2.

Figure 3:
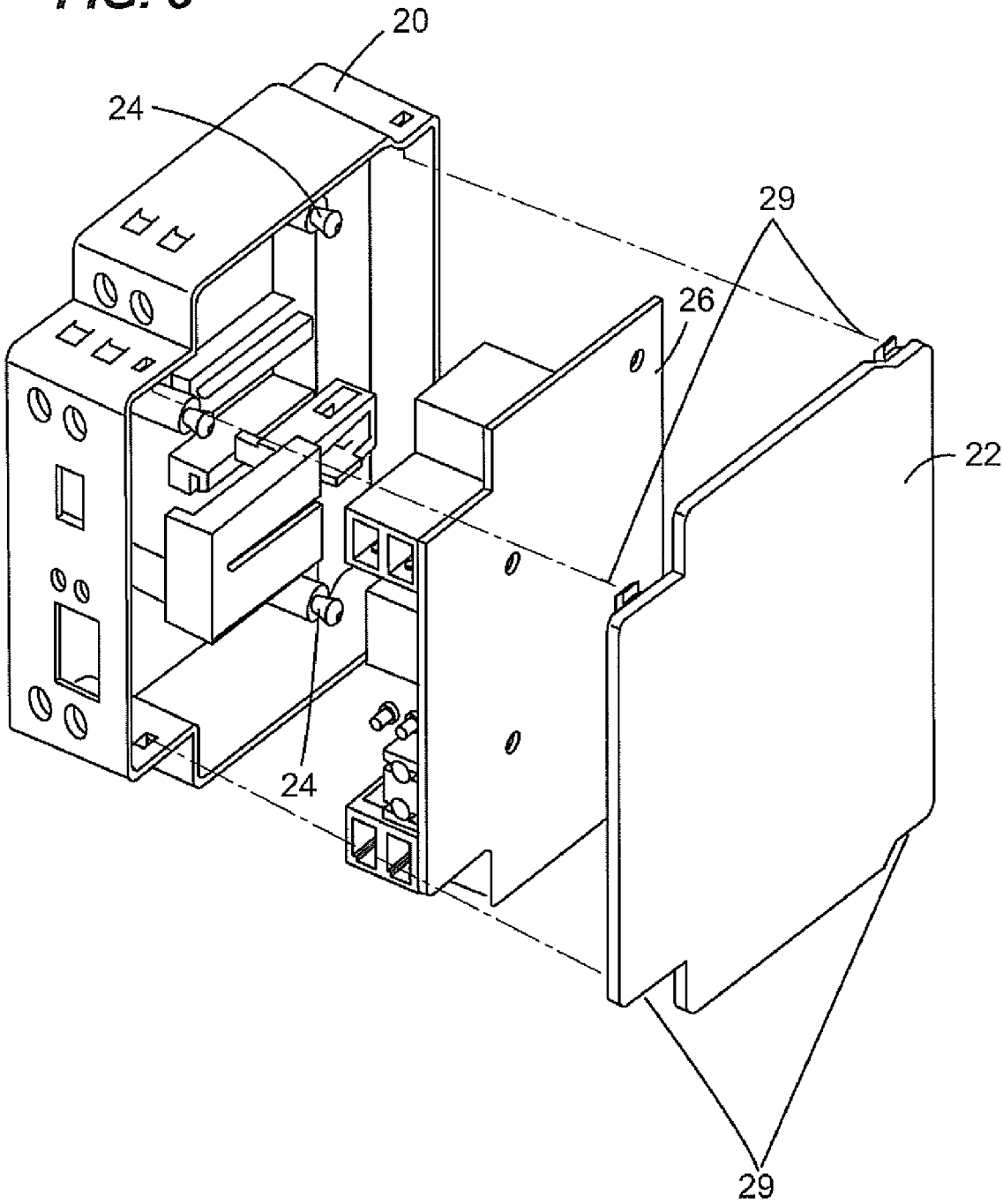
FIG. 3 is an exploded view of the contact position sensor module of FIG. 2.

Referring further to FIG. 3, the housing 12 may comprise a body 20 and a cover 22 that may be snap fitted through fitment arrangement shown in 29. A number of posts 24 may be provided whereupon a circuit board 26 may be mounted. The circuit board 26 may comprise a number of known suitable electrical and electronic components for energizing and monitoring output from a position sensor and which is described below.

Figure 4:
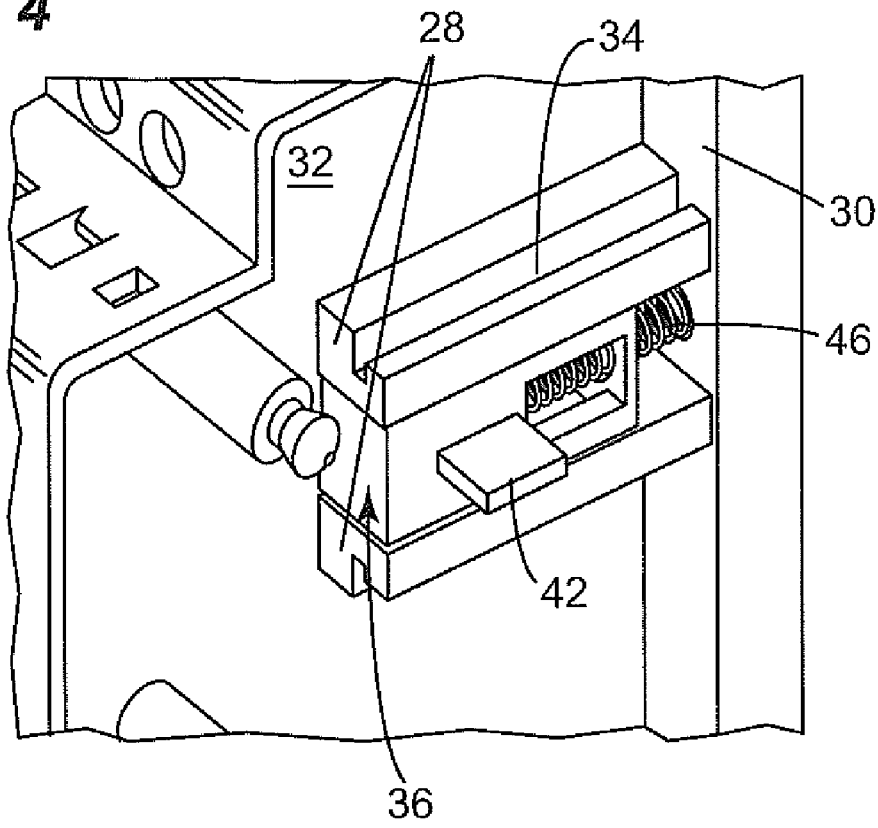
FIG. 4 is a perspective view of a latch located between support structures in a portion of the housing of FIG. 2.

As shown in FIG. 4, a pair of support structures 28 and stop structure 30 may extend from a surface 32 of the housing 12. The support structures 28 each comprise a generally elongated rectangular configuration and a mounting portion comprising a groove 34, the function of which is described below. Each support structure may be molded with the housing 12 or adhered to the surface 32 and extend generally parallel to each other and are spaced apart by a dimension to receive a latch 36 shown in more detail in FIG. 5.

Figure 5:
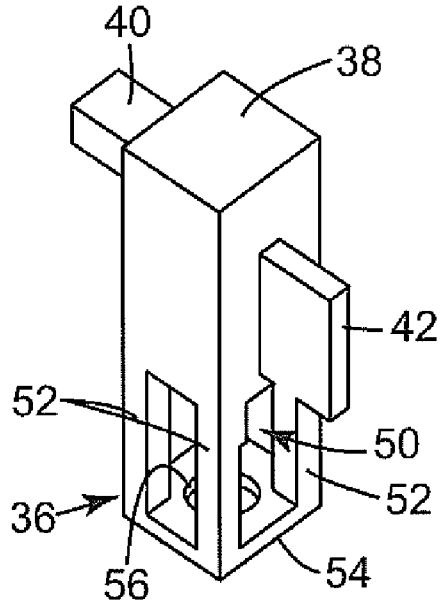
FIG. 5 is an enlarged, perspective view of the latch shown in FIG. 4.
Figure 6:
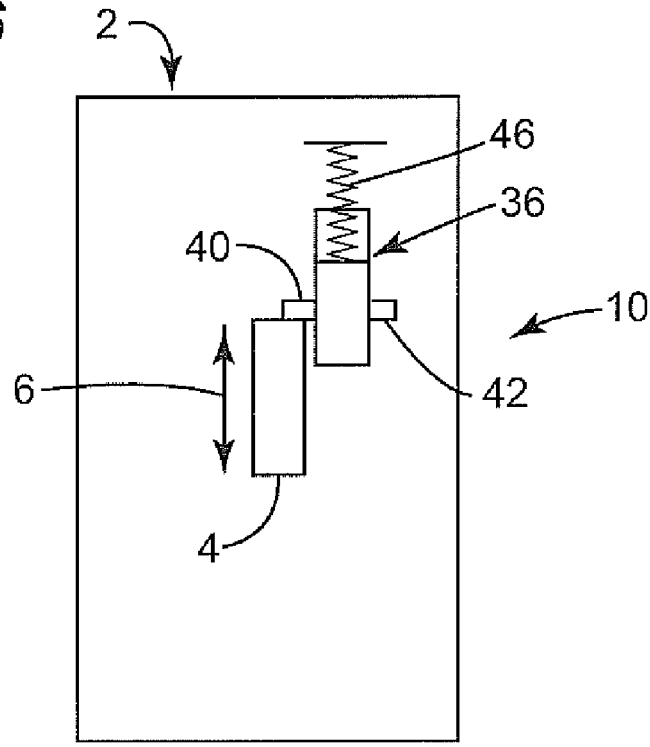
FIG. 6 is a diagram showing the latch biased in engagement with a contact carrier of the contact module of FIG. 1.

Referring now to FIG. 5, the latch 36 may comprise a polymeric substance and comprises a body portion 38 including a latch protrusion 40 (see also FIG. 2) and a latch member 42 extending from opposing sides (not numbered) of the latch 36. Each of the latch protrusion 40 and the latch member 42 may comprise blade-like outer configurations, although, each are oriented orthogonally with respect to each other. The latch member 42 is generally non-reflective or opaque as it is not configured to reflect light energy. As seen in FIG. 2, the latch protrusion 40 extends through a slot 44 in the surface 32 (FIG. 4) of the housing 12. Referring also to FIG. 6, a diagram showing engagement of the latch protrusion 40 with the contact carrier 4. A coil spring 46 biases the latch protrusion 40 against the contact carrier 4. The coil spring 46 may extend through a latch cavity 50 defined by four posts 52 and an end plate 54 having an aperture 56.

Figure 7:
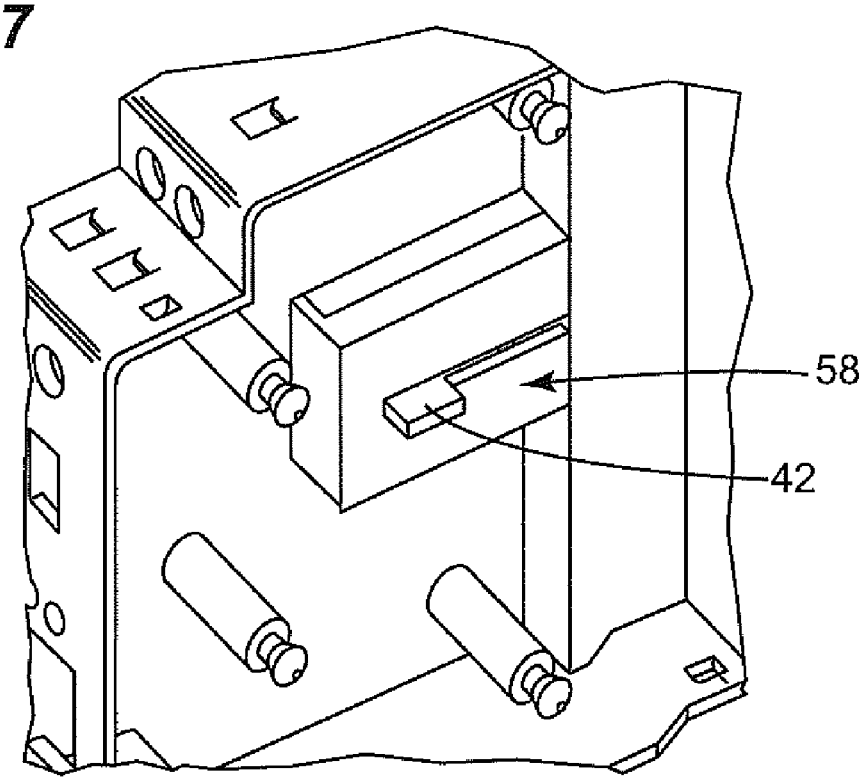
FIG. 7 is a view similar to that of FIG. 4 further showing a cover mounted to the support structures.
Figure 8:
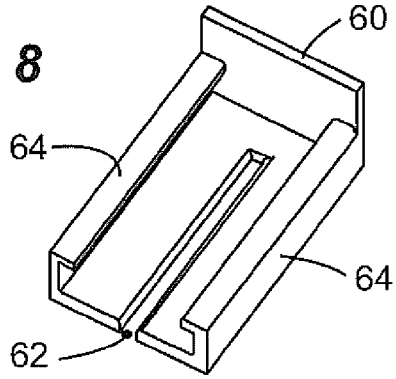
FIG. 8 is an enlarged, perspective view of the cover of FIG. 7.

As shown in FIGS. 4 and 7 a latch cover 58 also comprising a polymeric substance may be disposed over and cover the latch 36. Referring also to FIG. 8, the latch cover 58 may comprise a stop plate 60 and an elongated slot 62 wherethrough the latch member 42 may movably extend. A pair of mounting flanges 64 may be configured to engage the grooves 34 of the support structures 28 (see FIG. 4) when mounted thereto.

Figure 9:
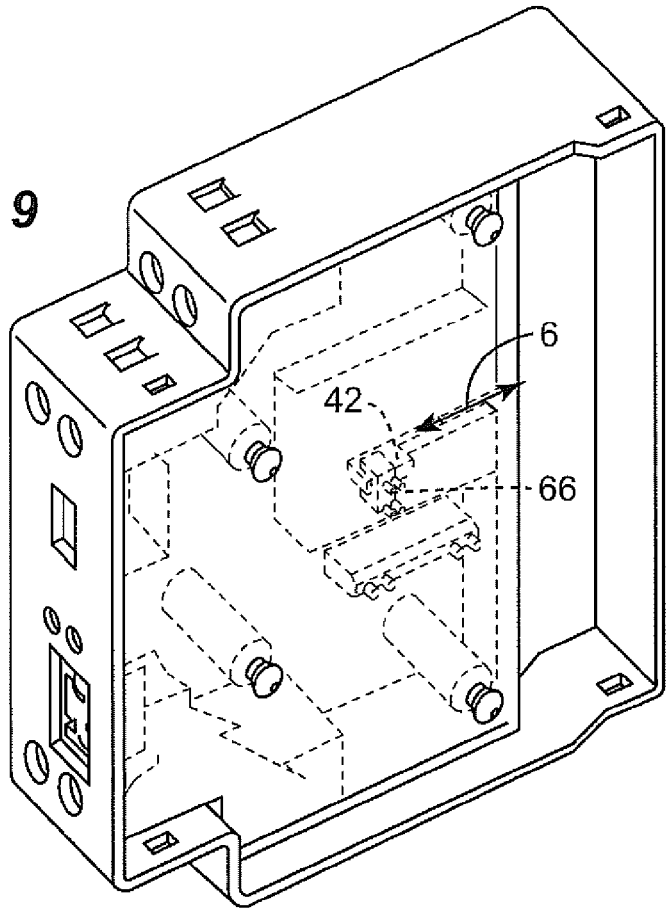
FIG. 9 is a perspective view similar to that of FIG. 7 further diagrammatically showing a sensor for sensing a position of a latch member of the latch of FIG. 4.
Figure 10:
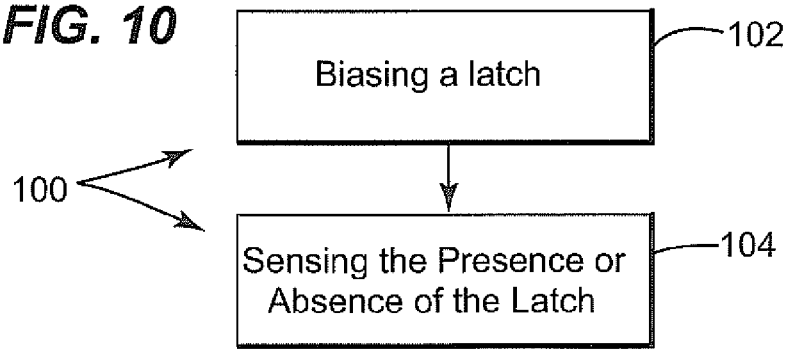
FIG. 10 is a flow diagram showing a method of sensing a position of a contact carrier of a contact module in accordance with another aspect of the present invention.

FIG. 9 diagrammatically illustrates a sensor 66 that is configured to sense the presence or absence of the latch member 42. In this embodiment, the sensor 66 is a transmissive optosensor such as that sold by the King Bright (Part no. KRA 01) company of China. The sensor 66 has a cavity (not numbered) wherein the presence of the latch member 42 may be determined. The presence of the latch member 42 is accomplished by interrupting the passage of light energy from one side of the cavity to another.

In operation and referring now also to FIG. 6, as the latch member 42 is moved in the direction of arrow 6 by the contact carrier 4, the presence of the latch member within which or absence is sensed by the sensor 66.

In accordance with another aspect of the present invention a method of sensing position of a contact carrier 4 of a contact module is shown generally at 100. The method comprising, as shown at 102, biasing a latch 36 into engagement with the contact carrier 4 and, as shown at 104, sensing the presence or absence of the latch 36 at a particular location.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A device for sensing the position of a contact carrier of a contact, comprising;

a housing;

a sensor supported by a housing;

a latch being movable by the contact carrier and comprising a generally non-reflective latch member located in proximity to the sensor;

wherein the sensor is configured to sense a presence or an absence of the latch member at one particular location depending upon the position of the contact carrier;

wherein the latch comprises a latch protrusion that is biased into engagement with the contact carrier; and wherein the housing comprises a pair of support structures and a stop structure and wherein the latch is slidable between each support structure of the pair of support structures.

2. The device of claim 1, wherein the latch comprises a generally rectangular outer configuration with the latch member disposed on one side and the latch protrusion disposed on an opposing side.

3. The device of claim 2, wherein the latch comprises a cavity and further comprising a coil spring for biasing the latch into engagement with the contact carrier and extending partially within the cavity and wherein the coil spring engages the stop structure.

4. The device of claim 3, further comprising a cover which engages the support structures and comprises an elongated slot wherethrough the latch member extends.

* * * * *

UNITED STATES PATENT AND TRADEMARK OFFICE

CERTIFICATE OF CORRECTION

PATENT NO. : 7,655,876 B2
APPLICATION NO. : 11/867769
DATED : February 2, 2010
INVENTOR(S) : Srinivasan et al.

It is certified that error appears in the above-identified patent and that said Letters Patent is hereby corrected as shown below:

In Column 4, Line 6, in Claim 1, delete "comprising;" and insert -- comprising: --, therefor.

Signed and Sealed this

Ninth Day of March, 2010

David J. Kappos

David J. Kappos
*Director of the United States Patent and Trademark Office*